United States Patent [19]

Pemberton

[11] 4,266,819

[45] May 12, 1981

[54] GRAPPLE APPARATUS

[76] Inventor: W. Bruce Pemberton, #314, Lake Howell Arms Apartments, Casselberry, Fla. 32707

[21] Appl. No.: 949,945

[22] Filed: Oct. 10, 1978

[51] Int. Cl.[3] ..... B66C 3/16; B66F 9/18

[52] U.S. Cl. ..... 294/88; 294/104; 414/622; 414/740

[58] Field of Search ..... 294/67 R, 67 A, 67 AB, 294/67 BB, 67 BC, 88, 103 R, 104; 414/618–623, 704, 715, 732, 733, 739–741

[56] References Cited

U.S. PATENT DOCUMENTS

| | | | |
|---|---|---|---|
| 2,874,862 | 2/1959 | Farmer et al. | 294/88 X |
| 3,127,209 | 3/1964 | Faust et al. | 294/88 |
| 3,194,421 | 7/1965 | Lull | 414/732 |
| 3,327,879 | 6/1967 | Lull | 294/88 X |
| 3,477,601 | 11/1969 | Gardner et al. | 414/704 |
| 3,817,567 | 6/1974 | Lull | 294/88 |
| 4,032,184 | 6/1977 | Blair | 414/732 X |

*Primary Examiner*—Johnny D. Cherry

[57] ABSTRACT

A self-adjusting pipe or pole grapple apparatus has a frame having a coupler system attached thereto for coupling to wheel or crawler type loaders. The grappler includes a pair of elongated lifting fork tines for lifting pipes, poles, or elongated members, and a pair of self-adjusting grapple arms hydraulically actuated to grip pipes or poles located on the fork. The grapple arms are self-adjusting for varying size loads supported on the forks.

10 Claims, 6 Drawing Figures

GRAPPLE APPARATUS

BACKGROUND OF THE INVENTION

The present invention relates to pipe or pole grapple attachments for wheel or crawler loaders, and especially to a grapple having self-adjusting arms adjusting for various size loads of pipes or poles.

DESCRIPTION OF THE PRIOR ART

A variety of attachments are available for both wheel and crawler type loaders, such as front end loaders, and allow one vehicle to perform a variety of jobs by shifting between attachments. The attachments may include loading buckets for hauling earth and gravel, or the like, and may also include lifting forks having a pair of tines for inserting under a pallet loaded with materials or under elongated objects, such as pipes, poles or logs, for lifting the material. In the present invention, the loading is with a forklift attachment having grapple arms for gripping the elongated pipes or poles and which self-adjust upon actuating of hydraulic cylinders to move the gripping arms for different size loads.

Typical prior art devices for gripping and hauling logs, poles or pipes might be seen in U.S. Pat. No. 2,799,412 for a log loader, or the like, having fork tines for lifting logs and a grapple arm for holding the logs onto the fork, and in U.S. Pat. No. 3,669,293 for a grapple system having flexible leaf springs for kickers and clamps for log stackers. In U.S. Pat. No. 3,275,173, a log loading vehicle includes a hydraulically actuated gripping arm for holding the logs onto a lifting surface, and in U.S. Pat. No. 3,338,442, a log loading apparatus has a fork for lifting the logs and a gripping arm hydraulically actuated. Overall, the prior art shows the use of special vehicles having forklifts for lifting logs, or the like, and gripping arms hydraulically actuated for holding the logs onto the forklift.

The present invention, on the other hand, allows a compact attachment which may be equipped with a coupling mechanism as illustrated in my prior U.S. Pat. No. 4,068,959 or any other type of coupling mechanism desired for attaching to existing vehicles, and which provides a pole or pipe grapple having a forklift arrangement and gripping arms, but which, advantageously, includes a linkage system for actuating the grapple arms and operates in conjunction with a track and sliding bracket supporting one end of the grapple arm to self-adjust for different loads resulting from either larger or smaller pipes or poles or from varying numbers of pipes or poles loaded onto the grapple.

SUMMARY OF THE INVENTION

The present invention relates to a self-adjusting pipe, pole or log grapple for wheel or crawler loaders, which has a frame with a system for coupling the frame and grapple to a loader. A pair of elongated fork tines are attached to and extend from the frame and a pair of tracks are mounted perpendicular to the fork tines and have a pair of sliding brackets slidably riding on the tracks. A pair of elongated grapple arms are each attached to one of the movable brackets sliding on one of the sliding tracks. A linkage is movably connected between the ends of each grapple arm and is movably attached to the frame and to a hydraulic cylinder for actuating the grapple arm to grip pipes, poles, logs, or the like, loaded on the fork tines, while the sliding brackets slide on the track to allow the grapple arms to adjust for varying size loads. The tracks have upper and lower stops to stop the sliding of the slidable brackets at certain points, and the linkage for actuating the grapple arms is a double linkage having a lever arm driven at one end by a hydraulic cylinder pinned to the frame and driving a second movable lever arm which engages the grapple arms.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
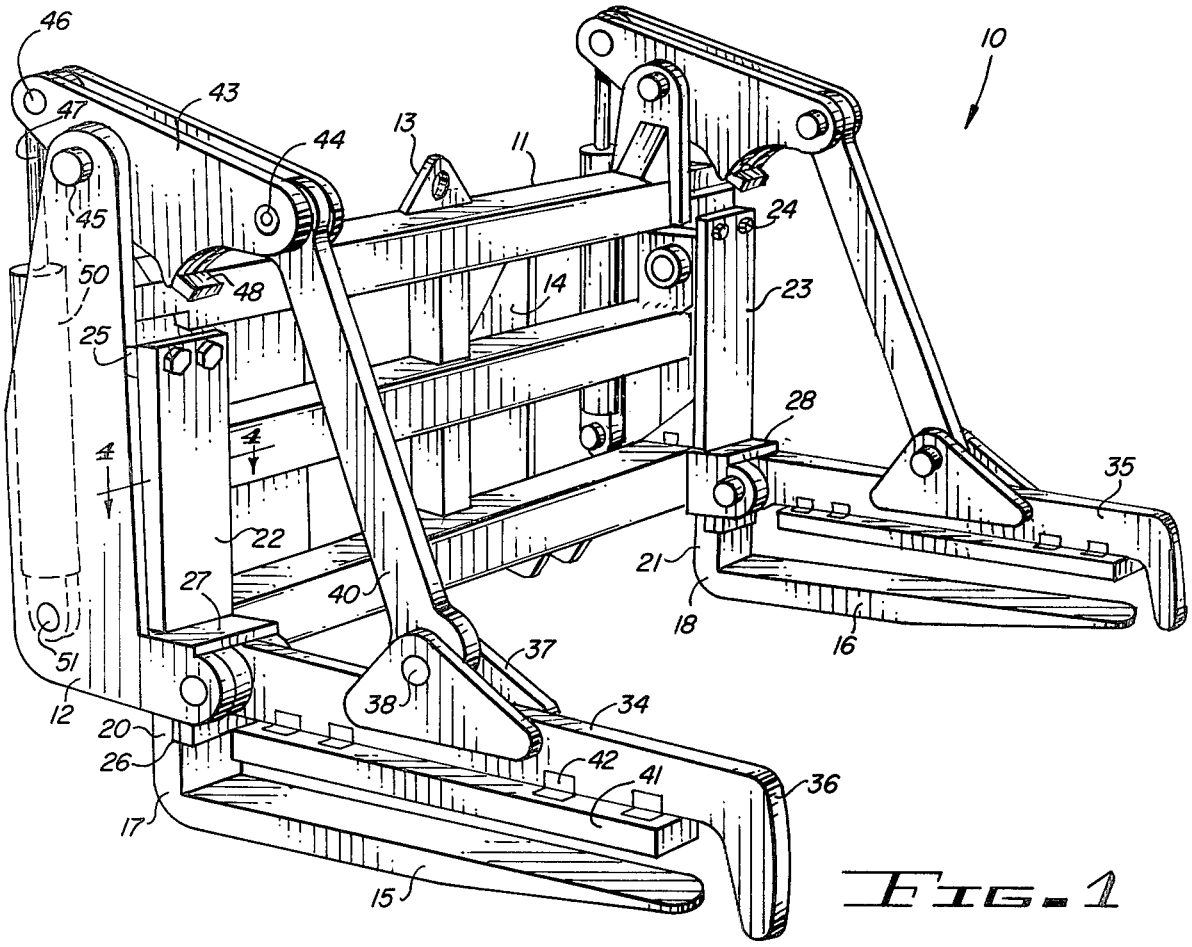
FIG. 1 is a perspective view of a pole or pipe grapple attachment in accordance with the present invention.
Figure 2:
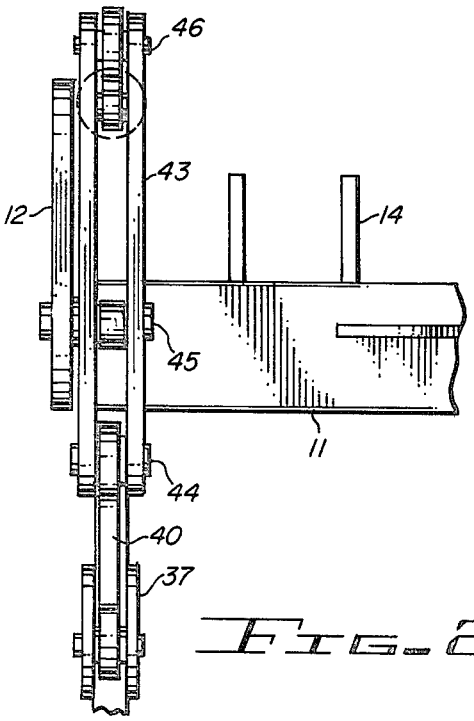
FIG. 2 is a top sectional view of the actuating linkage of the grapple of FIG. 1.
Figure 4:
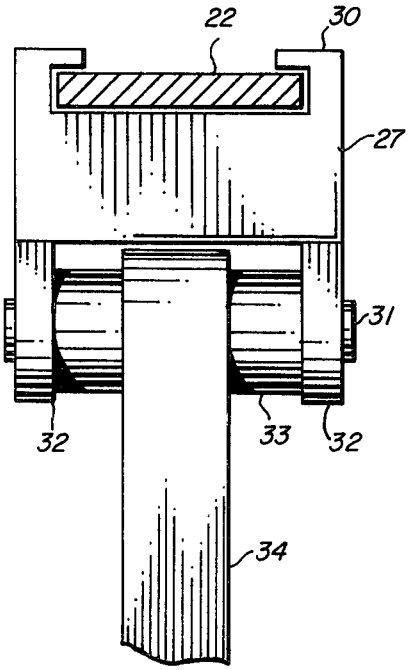
FIG. 4 is a sectional view taken on the line 4—4 of FIG. 1.

Referring now to the drawings, and especially to FIGS. 1, 2 and 4, a pole or pipe grapple 10 is illustrated having a frame having horizontal frame members 11 and vertically extending frame members 12 attached to the frame members 11 and may include a coupling system of any conventional type, which might include the bracket 13 attached to a vertical frame member 12 along with vertically extending coupling members 14. It will, of course, be clear that the attachment can be permanently attached to a vehicle such as a wheeled or crawler type loader if desired. The grapple attachment 10 has a pair of fork tines 15 and 16 attached to the frame members 11 and 12. The fork tines 15 and 16 have angles 17 and 18 at one end thereof and perpendicular extending portions 20 and 21. The vertically extending portion 20 has a track 22 attached thereto, while the vertically extending portion 21 has a track 23 attached thereto with a plurality of bolts 24. The bolts pass through upper stops 25 which act as spacers to space the track 22. A similar stop spaces the track 23. In addition, a bottom stop 26 is located behind each track 22 and 23 for spacing the tracks and providing a stopping point. Track 22 has a sliding bracket 27 sliding thereon, while track 23 has a sliding bracket 28. The bracket is designed as seen in FIG. 4 having support arms 30 wrapping around a portion of the track 22 to hold the bracket 27 to the track. The bracket 27 also has a pin 31 passing between yoke members 32 and having spacers 33 for supporting a grapple arm 34. The grapple arm 34 can accordingly rotate on the shaft 31 while the entire bracket 27 is free to slide up and down on the track 22. Bracket 28 has a grapple arm 35 attached thereto in the same manner that grapple arm 34 is attached to sliding bracket 27. Each grapple arm 34 and 35 is an elongated arm having a downwardly protruding foot 36 and a linkage connecting bracket 37 fixedly attached thereto and having a shaft 38 holding one end of an arm 40. In addition, each grapple arm 34 and 35 has a removable pad 41 which can be of a resilient material so that pipes can be gripped by the arms 34 and 35 without scratching or damaging the pipes. The removable pads 41 are held with angle brackets 42 and may be held with screws or bolts. Each linkage arm 40 is connected to a bell crank linkage arm 43 by a shaft 44 at the opposite end from the connection of linkage 40 to the bracket 37. The bell crank 43 is connected with a pin 45 to the vertically extending frame members 12, and by a pin 46 at a third point on the bell crank members 43 to a hydraulic cylinder power rod 47.

It should be noted that the bell crank 43 is formed of a pair of linkage members mounted parallel to each other and which may be partially held together by a steel block 48 which may act as a stop when the block 48 abuts against the surface of the linkage 40. Each power rod 47 is connected to a hydraulic cylinder 50 held with pins 51 at the opposite end of the frame members 12 from the pin 45. The double linkage is more clearly seen in FIG. 2, in which pairs of bell crank plates 43 have pins 46, 45 and 44 passing therethrough with the linkage 40 connected between bracket 37 which is also formed of a pair of steel plates. In addition, in FIG. 2, one pair of coupling plates 14 can be seen attached to horizontal frame members 11. When the unit is attached to a front end loader, or the like, the vehicle can approach a pallet or poles, pipes, or logs, drive the tines 15 and 16 thereunder and lift them with the loader. Actuating the hydraulic cylinders 50 drives the linkage 43 and 40 to actuate the grapple arms 34 and 35 down onto the pipes or poles for gripping and holding the pipes during movement.

Figure 3A:
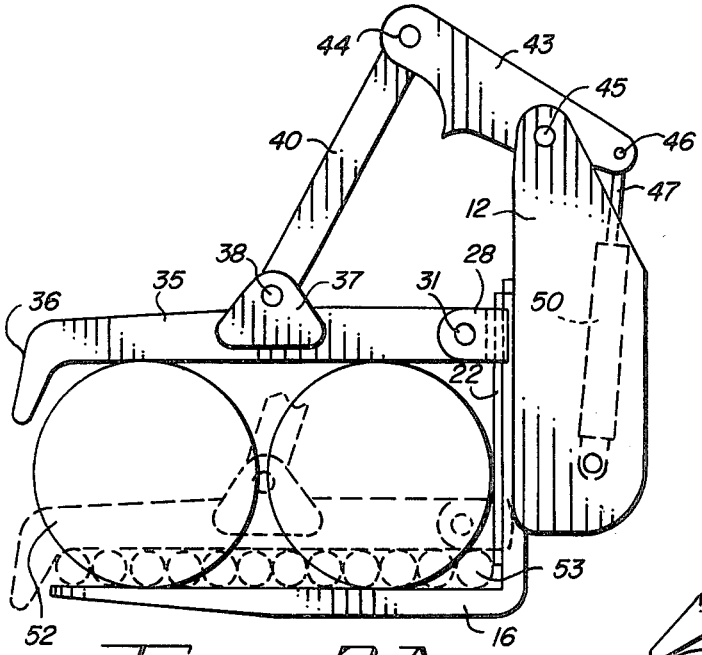
FIGS. 3*a*, 3*b* and 3*c* are side elevations of a pipe or pole grapple in accordance with FIG. 1 having various loads of pipes illustrating the self-adjusting positions for the grapple.
Figure 3B:
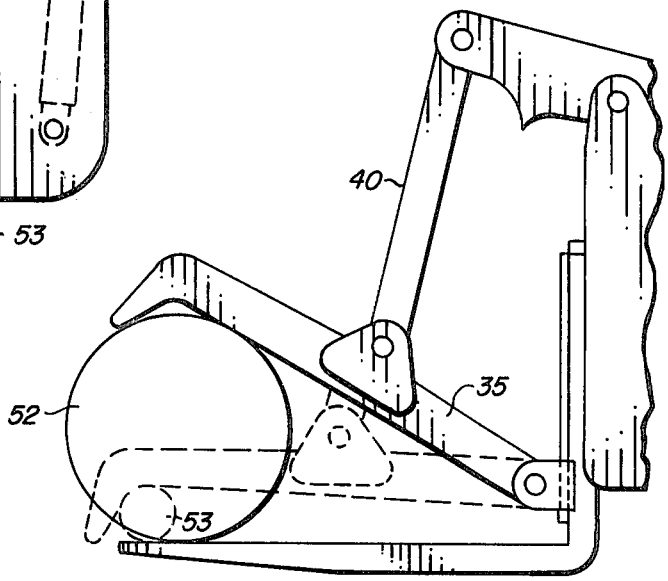
Figure 3C:
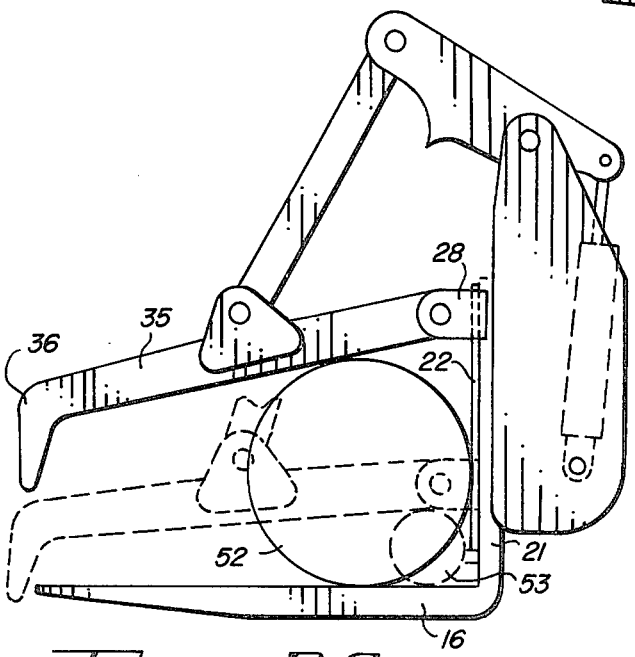

The linkage uses double linkage arms 40 and 43 rather than a single link, and sliding brackets 27 and 28 sliding on tracks allow the unit to be self-adjusting for different size loads of pipes or poles as more clearly illustrated in FIGS. 3*a*, 3*b* and 3*c*, which has the bell crank linkage arms 43 pinned with pins 45 to the frame members 12 and the hydraulic cylinder rods 47 pinned with the pins 46 at one end while a pin 44 at the opposite end of the bell crank link 43 is connected to the linkage member 40 at one end and the opposite end of the link 40 is connected with a pin 38 to bracket 37 attached to the elongated grapple arm 34. The elongated grapple arm has a foot 36 on one end and is held at the other end with pin 31 to the bracket 27. When the tines 15 and 16 lift a plurality of large pipes 52, the grapple arm 35 actuated by the hydraulic cylinder 50 is pushed down onto the pipes with the rear pipe forcing the bracket 28 to slide on the track 23, thereby lifting the rear of grapple arm 35, while the front of the grapple arm 35 grips the front pipe 52. If smaller pipes 53 are being gripped, the grapple arm 35, bracket 28 slides on the track 23 to a lower position as the whole grapple arm 35 is dropped. Utilizing the double linkage 40 and 43 allows greater latitude in the sliding of the bracket 28. In FIG. 3*b*, the grapple arm can grasp a single large pipe 52 or a single small pipe 53 with the bracket 28 in its lower position as the link 40 pushes the mid-portion of the grapple arm 35 to lower the bracket 28 while engaging the pipe 52 ro 53. Similarly, if the pipes 52 or 53 are located at the back portion of the fork tine 16 adjacent the vertically extending portion 21, then the bracket 28 will slide to the top portion of the track 23 while the foot portion 36 of the grapple arm 35 will go forward.

It might be noted that while the grapple arm 35 makes fairly long swings at either end thereof, the center portion to which the linkage 40 is connected is required to travel a relatively short distance while gripping a wide variety of loads, which may include large or small pipes, or larger or smaller numbers of smaller pipes or poles as desired. Inasmuch as the present invention is for heavy construction equipment, it is primarily constructed of heavy steel welded together and using heat treated pins for coupling points along with greased couplings to withstand the greater loads and stresses. However, the present invention is not to be construed as limited to the particular forms disclosed herein, which are to be considered illustrative rather than restrictive.

I claim:

1. A self-adjusting pipe and pole grapple for wheel and crawler loaders, or the like, comprising in combination:

a frame;

coupler means attached to said frame for coupling to a wheel or crawler loader, or the like;

a pair of elongated fork tines attached to said frame and extending therefrom;

a pair of tracks attached to said frame;

a pair of sliding brackets, one slidably mounted to each of said pair of tracks;

a pair of elongated grapple arms, each arm movably attached at one end portion thereof to one said sliding bracket;

hydraulic actuating means for actuating said pair of elongated grapple arms; and linkage means movably attached to each said elongated grapple arm between the ends thereof and to said hydraulic actuating means, said linkage means having a first linkage arm movably attached to each said grapple arm and a second linkage arm movably attached to said first linkage arm and to said frame and also attached to a hydraulic actuating means hydraulic cylinder, whereby actuation of the hydraulic cylinder will drive said second linkage arm pivoting on said frame to drive said first linkage arm and said grapple arm so that said hydraulic actuating means actuates said linkage means and grapple arms to grip pipes, poles, or the like, on said pair of fork tines and said sliding brackets slide on said track to allow said grapple arms to adjust for varying size loads or pipes, poles, or the like.

2. The grapple in accordance with claim 1, in which each said track has a top stop member to stop each said sliding bracket at a predetermined point.

3. The grapple in accordance with claim 2, in which each said track has a bottom stop member for stopping said sliding bracket at a predetermined point on said track.

4. The grapple in accordance with claim 3, in which said track includes an elongated flat steel plate member and said sliding bracket has support arms extending at least partially around said elongated flat steel plate member, whereby said sliding bracket can slide on said track.

5. The grapple in accordance with claim 4, in which each said grapple arm has a removably attached resilient pad attached thereto.

6. The grapple in accordance with claim 5, in which each grapple arm has a plurality of angle brackets fixedly attached thereto for removably attaching said resilient pads thereto with threaded fastener members.

7. The grapple in accordance with claim 6, in which each grapple arm has a downwardly extending foot formed thereon.

8. The grapple in accordance with claim 7, in which said hydraulic actuating means includes a pair of hydraulic cylinders each movably attached at one end portion thereof to said frame and having the power rod of each hydraulic cylinder movably coupled to said second linkage member.

9. The grapple in accordance with claim 8, in which said track elongated flat steel plate member is attached to said frame with a plurality of bolts attached through said stop members.

10. The grapple in accordance with claim 9, in which said second linkage arm has a stop member for stopping the movement of said first linkage arm at a predetermined position.

* * * * *